US008419277B2

(12) United States Patent
Schneider

(10) Patent No.: US 8,419,277 B2
(45) Date of Patent: Apr. 16, 2013

(54) EASY OPEN SLIDER PACKAGE

(75) Inventor: John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 1996 days.

(21) Appl. No.: 11/045,834

(22) Filed: Jan. 28, 2005

(65) Prior Publication Data

US 2006/0171607 A1 Aug. 3, 2006

(51) Int. Cl.
*B65D 33/00* (2006.01)
*B65D 33/16* (2006.01)

(52) U.S. Cl.
USPC ..... 383/36; 383/61.2; 383/64; 383/204

(58) Field of Classification Search ..... 383/61.2, 383/61.3, 63, 64, 36, 48, 203, 204, 5
See application file for complete search history.

(56) References Cited

U.S. PATENT DOCUMENTS

| | | | | |
|---|---|---|---|---|
| 2,799,314 | A * | 7/1957 | Dreyer et al. | 383/44 |
| 3,297,152 | A * | 1/1967 | Corella et al. | 206/221 |
| 3,746,215 | A * | 7/1973 | Ausnit et al. | 222/92 |
| 3,991,801 | A * | 11/1976 | Ausnit | 383/61.2 |
| 5,063,639 | A * | 11/1991 | Boeckmann et al. | 24/30.5 R |
| 5,354,132 | A * | 10/1994 | Young et al. | 383/49 |
| 5,456,928 | A * | 10/1995 | Hustad et al. | 426/87 |
| 6,273,607 | B1 * | 8/2001 | Buchman | 383/5 |
| 6,327,837 | B1 * | 12/2001 | Van Erden | 53/412 |
| 6,357,914 | B1 * | 3/2002 | Kinigakis et al. | 383/64 |
| 6,467,956 | B1 * | 10/2002 | Tilman et al. | 383/61.3 |
| 6,604,651 | B2 * | 8/2003 | Amundson et al. | 221/47 |
| 6,783,276 | B2 * | 8/2004 | Machacek et al. | 383/36 |
| 7,004,630 | B2 * | 2/2006 | Piechocki et al. | 383/36 |
| 2001/0017947 | A1 * | 8/2001 | Strand et al. | 383/61 |
| 2003/0113415 | A1 | 6/2003 | Strand | |
| 2003/0231811 | A1 * | 12/2003 | Hodson et al. | 383/208 |
| 2005/0157959 | A1 * | 7/2005 | Johnson | 383/61.2 |

FOREIGN PATENT DOCUMENTS

| | | | |
|---|---|---|---|
| EP | 1 070 672 | A | 1/2001 |
| JP | 2002302132 | A * | 10/2002 |
| WO | WO 2006/037240 | A | 4/2006 |

OTHER PUBLICATIONS

Translation of Japanese Document No. JP 2002-302132 A Translated Aug. 2009 by The McElroy Translation Company 15 Pages.*

* cited by examiner

*Primary Examiner* — Jes F Pascua
(74) *Attorney, Agent, or Firm* — McCarter & English, LLP

(57) ABSTRACT

A reclosable bag is disclosed which includes a reclosable zipper with interlocking profiles and a slider. The interlocking profiles include flanges which include arcuate cut-outs at the ends thereof. The width of the flanges is thereby reduced at the distal ends thereof. This allows the flanges to be sealed to the front and rear panels of the reclosable bag without being sealed within the side seals of the reclosable bag. In order to maintain the integrity of the bag, the flanges are sealed to each other immediately inwardly adjacent from the arcuate cut-outs, and the seal lines between the flanges and the front and rear panels are extended so that the front and rear panels are sealed to each other in an area bounded by the arcuate cut-outs and the side seals.

27 Claims, 2 Drawing Sheets

EASY OPEN SLIDER PACKAGE

BACKGROUND OF THE INVENTION

1. Field of the Invention

The present invention pertains to a reclosable package, including a zipper with a slider, wherein a portion of the zipper flange in the side seal area is removed while leaving the profile of the zipper intact.

2. Description of the Prior Art

In the prior art of manufacturing reclosable bags, typically, in the side seal area, the zipper profile is removed thereby leaving most of the flange intact. While this has been satisfactory in many respects, it has been problematic in that, as the flanges are typically thin, the flanges can stretch when feeding a prepared zipper (i.e., with the profile punched and sealed) into a bag making or form fill seal machine. This can result in degraded registration of the zipper assembly to the packaging film.

OBJECTS AND SUMMARY OF THE INVENTION

It is therefore an object of the present invention to provide improvements in the manufacturing of reclosable bags wherein stretching or deformation of the prepared zipper during feeding thereof is reduced thereby increasing the accuracy of the registration of the zipper assembly to the packaging film.

This and other objects are attained by providing a method and apparatus wherein the zipper flanges have arcuate cut-out portions at the ends thereof, so that the zipper flanges are not sealed within the side seal. The zipper profiles, which are much thicker and more rigid than the flanges, are left intact for the feeding of the prepared zipper. This provides a more rigid spine for the zipper thereby providing improved registration of the zipper assembly to the packaging film as the prepared zipper assembly is fed to the bag making or form fill seal machine. The resulting package design has an increased mouth opening while maintaining the ease of opening associated with similar package designs.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
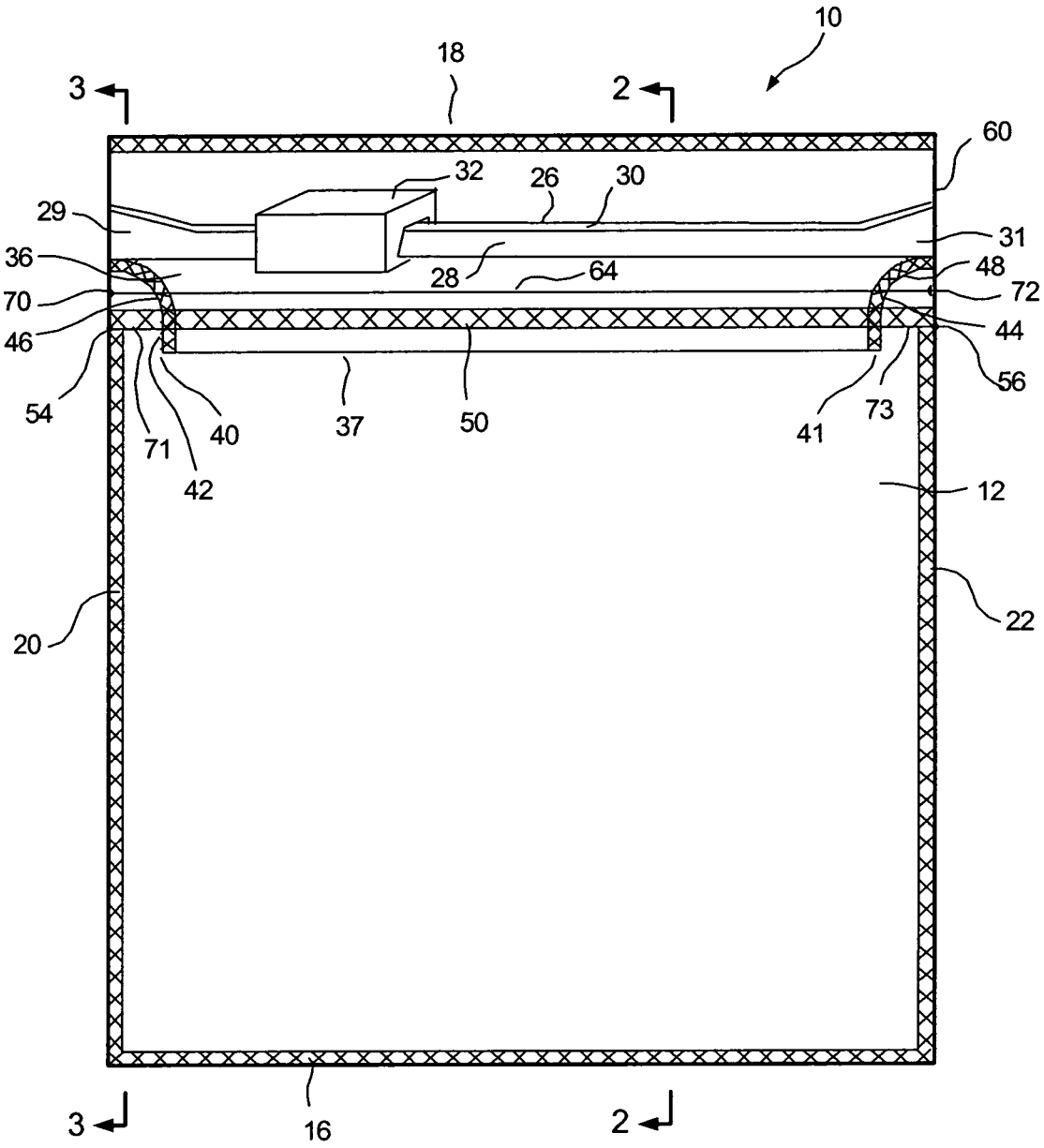
FIG. 1 is a front plan view of the reclosable bag of the present invention.

Referring now to the drawings in detail wherein like numerals refer to like drawings throughout the several views, one sees that FIG. 1 is a front plan view of reclosable bag 10 of the present invention. Reclosable bag 10 includes front panel 12 and rear panel 14 (see FIG. 2) which are made from film or web and sealed together by bottom seal 16, top seal 18, and side seals 20, 22. Alternative configurations could substitute at least one of the seals for a fold wherein the front panel 12 and rear panel 14 would be formed from a single sheet of web. Zipper 26 includes first interlocking profile 28, second interlocking profile 30 and slider 32. As is known to those skilled in the art, movement of slider 32 in a first direction interlocks profiles 28, 30 to each other while movement of slider 32 in a second direction unlocks profiles 28, 30 from each other. First and second interlocking profiles 28, 30 are sealed to each other at the ends thereof to form end stops 29, 31 to prevent slider 32 from going beyond the extent of first and second interlocking profiles.

As further shown in the figures, first and second interlocking profiles 28, 30 include respective first and second flanges 36, 38. First and second flanges 36, 38 may be standard zipper flanges, or hermetic zipper flanges such as found in U.S. Pat. No. 6,354,738. As shown in FIG. 1, the first end 40 of first and second flanges 36, 38 includes arcuate cut-out 42 and, likewise, the second end 41 of first and second flanges 36, 38 includes arcuate cut-out 44. Arcuate cut-outs 42, 44 are formed so that flanges 36, 38 extend along the full length of profiles 28, 30, but the width of flanges 36, 38 is thereafter reduced, particularly at their respective distal ends 37, 39, whereby flanges 36, 38 do not extend into side seals 20, 22. First and second flanges 36, 38 are sealed to each other along arcuate seals 46, 48 immediately inwardly adjacent to arcuate cut-outs 42, 44. Typically, arcuate seals 46, 48 are formed by the same process which removes the flange material to form arcuate cut-outs 42, 44.

First and second seal lines 50, 52 extend across front and rear panels 12, 14, from the top 54 of side seal 20 to the top 56 of side seal 22. First and second flanges 36, 38 are sealed to respective front and rear panels 12, 14 along first and second seal lines 50, 52. In the regions 71, 73, outward of arcuate cut-outs 42, 44 and inward of side seals 20, 22, first and second seal lines 50, 52 join thereby sealing the front and rear panels 12, 14 together in regions 71, 73. As side seals 20, 22 do not extend above respective tops 54, 56, an open-ended header 60 is formed between seal lines 50, 52 and top seal 18 (see FIG. 3).

Figure 2:
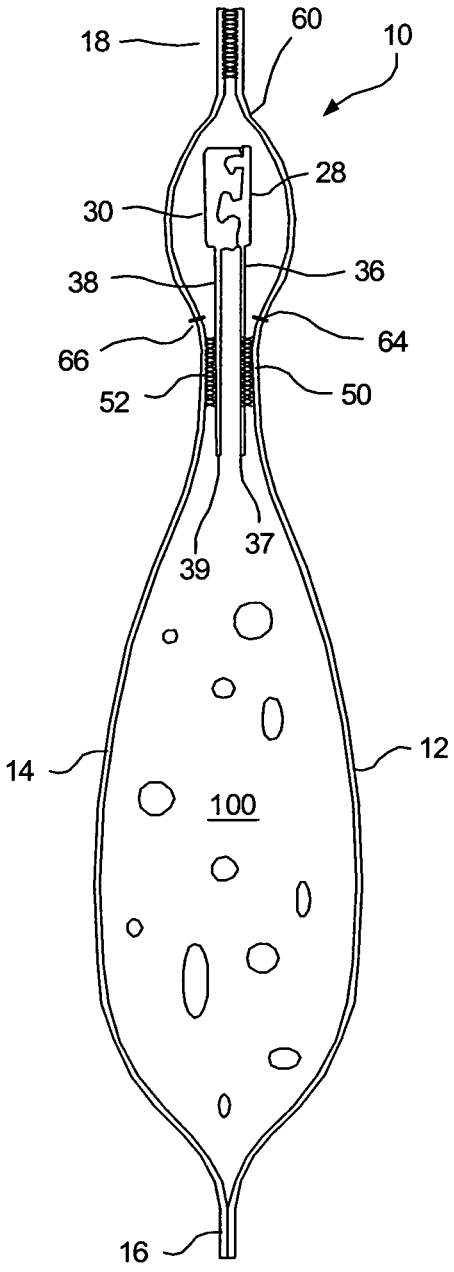
FIG. 2 is a cross-sectional view along plane 2-2 of FIG. 1. In particular, this cross-sectional view is across a plane where no portion of the flange has not been removed.
Figure 3:
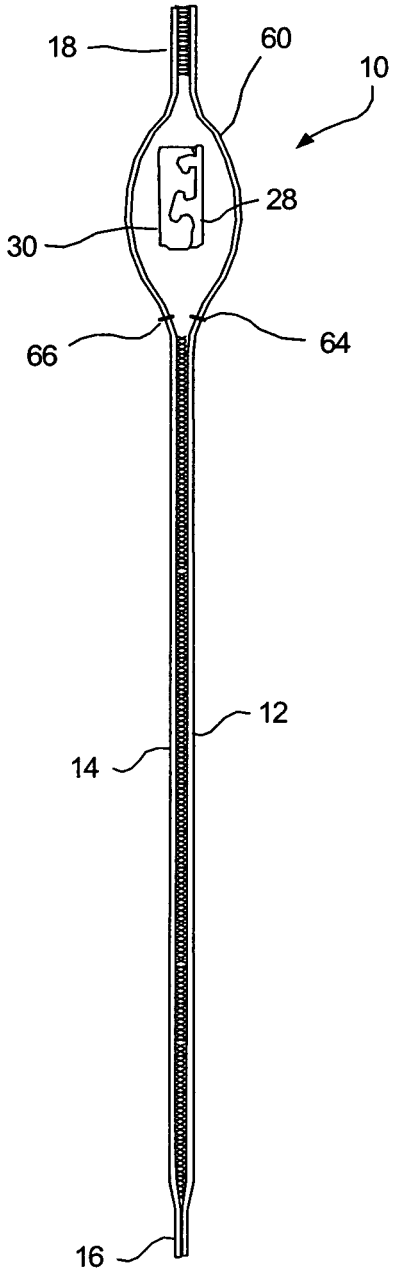
FIG. 3 is a cross-sectional view along plane 3-3 of FIG. 1. In particular, this cross-sectional view is across a plane, near a side seal, where the flange has been removed.

As shown in FIGS. 2 and 3, lines of weakness 64, 66 are formed in front and rear panels 12, 14, respectively, in the open-ended header 60, immediately above the first and second seal lines 50, 52 and below the level of the slider 32. Lines of weakness 64, 66 may be formed from any methods known in the prior art, such as laser scoring, mechanical scoring or perforating. Additionally, as shown in FIG. 1, notches 70, 72 are formed at ends of lines of weakness 64 (as well as line of weakness 66, not shown in FIG. 1) in order to facilitate the tearing of the lines of weakness 64, 66 and the removal of the header 60 by the user. Thereby, the user is able to open zipper 26 by moving slider 32 and having access to the contents 100 (see FIG. 2), typically snack foods or other foodstuffs. Reclosable bag 10 can thereafter be reclosed by moving slider 32 in the opposite direction so as to interlock profiles 28, 30.

An alternative embodiment would include a peel seal (not shown) and involve the removal of only a portion of header 60 by the user during the opening process.

Another alternative embodiment would seal front and rear panels 12, 14 together, including a portion of flanges 36, 38, above the lines of weakness 64, 66 and above (and separated from) tops 54, 56 of side seals 20, 22.

Thus the several aforementioned objects and advantages are most effectively attained. Although a preferred embodiment of the invention has been disclosed and described in detail herein, it should be understood that this invention is in no sense limited thereby and its scope is to be determined by that of the appended claims.

What is claimed is:

1. A reclosable bag comprising:

a front panel and a rear panel;

first and second side seals joining said front panel to said rear panel;

a reclosable zipper including a first interlocking profile, a second interlocking profile and a slider;

said first interlocking profile including a first flange which is sealed to said front panel along a first flange seal;

said second interlocking profile including a second flange which is sealed to said rear panel along a second flange seal;

said first flange and said second flange including portions with a width less than a width of said reclosable zipper; and wherein said first flange and said second flange are substantially free of being sealed within said first and second side seals;

a first region wherein the first flange seal is joined to the second flange seal extending from the first side seal to a first end of the first and second flanges; and a second region wherein the first flange seal is joined to the second flange seal extending from the second side seal to a second end of the first and second flanges.

2. The reclosable bag of claim 1 further including a bottom seal joining said front panel to said rear panel.

3. The reclosable bag of claim 2 wherein said first side seal and said second side seal extend from said bottom seal to an area proximate to said first and second flange seals.

4. The reclosable bag of claim 3 wherein said portions with a width less than a width of said reclosable zipper are formed by arcuate cut-outs on ends of said first and second flanges.

5. The reclosable bag of claim 4 wherein said first flange is sealed to said second flange along arcuate seals immediately adjacent to said arcuate cut-outs.

6. The reclosable bag of claim 5 wherein said front panel is sealed to said rear panel in areas extending from said first and second flange seals and bounded by said side seals and said arcuate seals.

7. The reclosable bag of claim 6 further including a top seal joining said front panel to said rear panel.

8. The reclosable bag of claim 7 wherein said front and rear panels extend over said zipper to said top seal, thereby forming a header.

9. The reclosable bag of claim 8 wherein said header is open at ends thereof.

10. The reclosable bag of claim 9 further including at least one line of weakness in said header.

11. A reclosable bag comprising:

a front panel and a rear panel;

first and second side seals joining said front panel to said rear panel;

a reclosable zipper including a first interlocking profile, a second interlocking profile and a slider;

said first interlocking profile including a first flange which is sealed to said front panel along a first flange seal;

said second interlocking profile including a second flange which is sealed to said rear panel along a second flange seal;

said first flange and said second flange including portions with a width less than a width of said front and rear panel; and wherein said first flange and said second flange are substantially free of being sealed within said first and second side seals;

a first region wherein the first flange seal is joined to the second flange seal extending from the first side seal to a first end of the first and second flanges; and a second region wherein the first flange seal is joined to the second flange seal extending from the second side seal to a second end of the first and second flanges.

12. The reclosable bag of claim 11 further including a bottom seal joining said front panel to said rear panel.

13. The reclosable bag of claim 12 wherein said first side seal and said second side seal extend from said bottom seal to an area proximate to said first and second flange seals.

14. The reclosable bag of claim 13 wherein said portions with a width less than a width of said front and rear panels are formed by arcuate cut-outs on ends of said first and second flanges.

15. The reclosable bag of claim 14 wherein said first flange is sealed to said second flange along arcuate seals immediately adjacent to said arcuate cut-outs.

16. The reclosable bag of claim 15 wherein said front panel is sealed to said rear panel in areas extending from said first and second flange seals and bounded by said side seals and said arcuate seals.

17. The reclosable bag of claim 16 further including a top seal joining said front panel to said rear panel.

18. The reclosable bag of claim 17 wherein said front and rear panels extend over said zipper to said top seal, thereby forming a header.

19. The reclosable bag of claim 18 wherein said header is open at ends thereof.

20. The reclosable bag of claim 19 further including at least one line of weakness in said header.

21. A reclosable bag comprising:

a front panel and a rear panel;

first and second side seals joining said front panel to said rear panel;

a reclosable zipper including a first interlocking profile, a second interlocking profile and a slider;

said first interlocking profile including a first flange which is sealed to said front panel along a first flange seal;

said second interlocking profile including a second flange which is sealed to said rear panel along a second flange seal;

wherein said front and rear panels extend over said zipper to a top seal, thereby forming a header;

wherein said header includes at least one line of weakness; and said first flange and said second flange including portions with a width less than a width of said reclosable zipper; and wherein said first flange and said second flange are substantially free of being sealed within said first and second side seals below said at least one line of weakness;

a first region wherein the first flange seal is joined to the second flange seal extending from the first side seal to a first end of the first and second flanges; and a second region wherein the first flange seal is joined to the second flange seal extending from the second side seal to a second end of the first and second flanges.

22. The reclosable bag of claim 21 further including a bottom seal joining said front panel to said rear panel.

23. The reclosable bag of claim 22 wherein said first side seal and said second side seal extend from said bottom seal to an area proximate to said first and second flange seals.

24. The reclosable bag of claim 23 wherein said portions with a width less than a width of said reclosable zipper are formed by arcuate cut-outs on ends of said first and second flanges.

25. The reclosable bag of claim 24 wherein said first flange is sealed to said second flange along arcuate seals immediately adjacent to said arcuate cut-outs.

26. The reclosable bag of claim 25 wherein said front panel is sealed to said rear panel in areas extending from said first and second flange seals and bounded by said side seals and said arcuate seals.

27. The reclosable bag of claim 26 wherein said header is open at ends thereof.

* * * * *